United States Patent [19]

Bishop

[11] 4,325,656

[45] Apr. 20, 1982

[54] APPARATUS AND METHOD FOR FORMING OFF-SHORE ICE ISLAND STRUCTURE

[76] Inventor: Gilbert H. Bishop, 800 E. Ocean Blvd. Ste. 801, Long Beach, Calif. 90802

[21] Appl. No.: 167,931

[22] Filed: Jul. 14, 1980

Related U.S. Application Data

[63] Continuation-in-part of Ser. No. 85,001, Oct. 15, 1979, abandoned.

[51] Int. Cl.[3] ..... E02D 19/04; E02B 3/00

[52] U.S. Cl. ..... 405/217; 62/260; 405/61; 405/11

[58] Field of Search ..... 405/217, 130, 61, 11–14, 405/195–210; 62/259 R, 260, 66, 99, 235; 165/45, 48

[56] References Cited

U.S. PATENT DOCUMENTS

| | | | |
|---|---|---|---|
| Re. 29,413 | 9/1977 | Hekkanen et al. | 405/204 |
| 559,116 | 4/1896 | Baldwin | 405/204 X |
| 1,855,113 | 4/1932 | Nolte | 405/14 |
| 2,574,140 | 11/1951 | Boschen | 405/204 |
| 2,637,172 | 5/1953 | Howard | 405/205 |
| 2,705,403 | 4/1955 | Ebert | 405/14 X |
| 2,857,744 | 10/1958 | Swiger et al. | 405/208 |
| 2,940,266 | 6/1960 | Smith | 405/204 |
| 3,094,847 | 6/1963 | Pogonowski | 405/204 |
| 3,380,255 | 4/1968 | Schroeder | 405/11 |
| 3,488,967 | 1/1970 | Toossi | 405/205 X |
| 3,543,523 | 12/1970 | Nelson | 405/217 X |
| 3,710,579 | 1/1973 | Killmer et al. | 405/11 |
| 3,710,582 | 1/1973 | Hills et al. | 405/205 |
| 3,738,114 | 6/1973 | Bishop | 62/260 X |
| 3,740,956 | 6/1973 | Guy et al. | 62/260 X |
| 3,750,412 | 8/1973 | Fitch et al. | 405/217 |
| 3,952,527 | 4/1976 | Vinieratos et al. | 405/217 |
| 4,187,039 | 2/1980 | Jahns et al. | 405/217 |
| 4,192,630 | 3/1980 | Duthweiler | 405/217 |
| 4,205,928 | 6/1980 | Thompson et al. | 405/217 |

*Primary Examiner*—Dennis L. Taylor

*Attorney, Agent, or Firm*—Fulwider, Patton, Rieber, Lee & Utecht

[57] ABSTRACT

A method and apparatus for forming an off-shore ice island structure in waters which normally freeze in the winter. The ice island is useful as a base for oil field operations, for oil and gas storage, for docking ships during thaw periods, and the like. The structure comprises a plurality of elongated hollow wall elements adapted to be vertically oriented and assembled in open water to form a bounded area. The elements become frozen in place during the winter and the bounded area is intermittently flooded at intervals to permit accumulation of ice sufficient to sink the ice island to the marine bottom. Additional wall elements are added to the first wall elements to form upward continuations to contain the flooding water and accumulated ice. Pumps are provided to convey water to the upper surface of the island for freezing, and to carry off brine during the freezing process. Refrigeration equipment can be utilized to keep the ice island in a frozen condition during seasonal thaws. The island can be adapted to be moved to other sites during thaw periods.

23 Claims, 12 Drawing Figures

FIG. 5
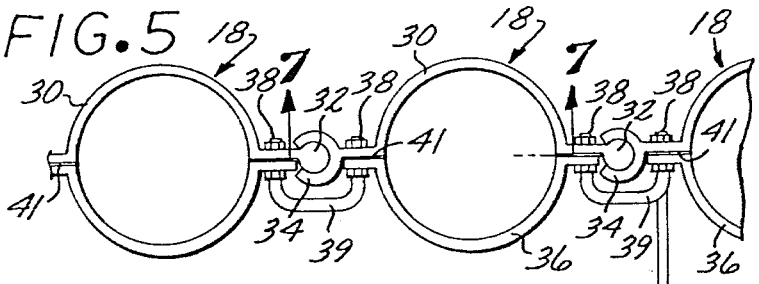
FIG. 6
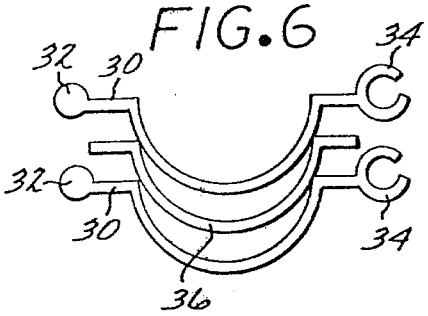
FIG. 7
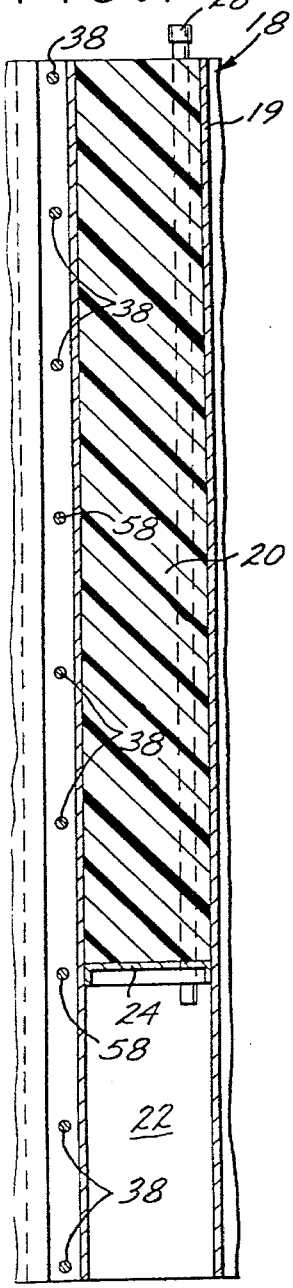
FIG. 8
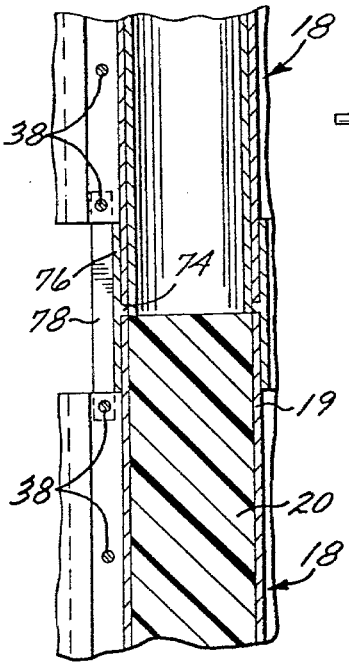
FIG. 9
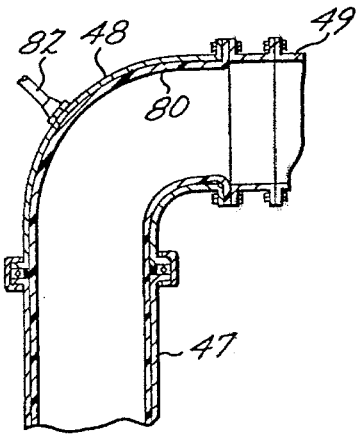
FIG. 10
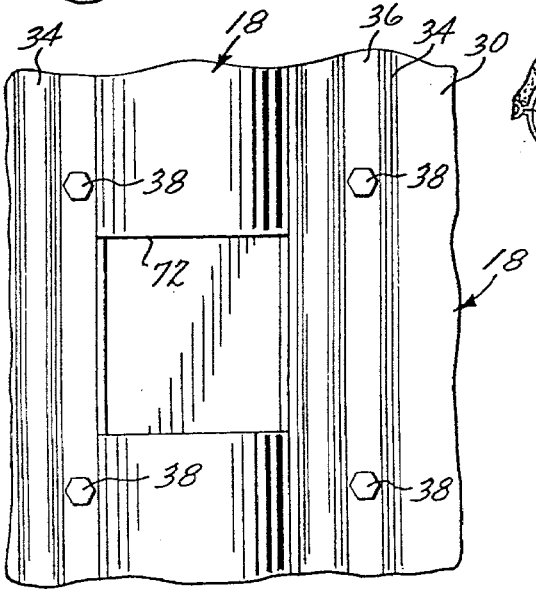
FIG. 11
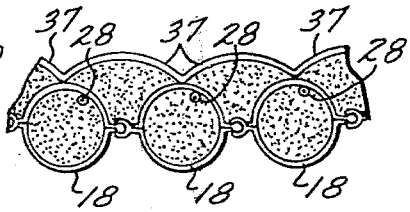
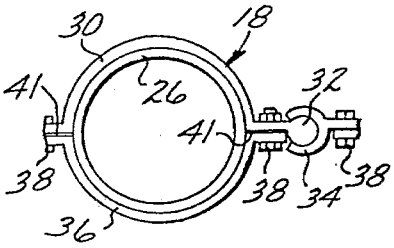
FIG. 12

APPARATUS AND METHOD FOR FORMING OFF-SHORE ICE ISLAND STRUCTURE

This application is a continuation-in-part of my copending patent application Ser. No. 06/085,001, filed Oct. 15, 1979 and entitled "APPARATUS AND METHOD FOR FORMING OFF-SHORE ICE ISLAND STRUCTURE", now abandoned, and the benefit of the filing date of such copending patent application is claimed for the subject matter of this application which is common to such earlier copending application.

BACKGROUND OF THE INVENTION

1. Field of the Invention

The present invention relates to a method and apparatus for forming an off-shore ice island structure, and more particularly for forming such an ice island structure in open waters.

2. Description of the Prior Art

In my U.S. Pat. No. 3,738,114, entitled "Method and Apparatus for Forming Ice Island for Drilling or the Like", issued June 12, 1973, a method and apparatus is disclosd for forming an ice island on natural ice in cold regions such as the north slope of Alaska. The present method and apparatus is similar in many respects to that disclosed in the above-identified patent, except that, as will be seen, the present method and apparatus can be utilized to form an ice island structure in open waters. There is no need to wait for sea water to freeze to a depth sufficient to support the weight of construction equipment and wall structures. Instead, the first part of the winter can be used to build up the ice island height.

As described in more detail in the patent, recovery of underwater resources such as oil from off-shore areas in Arctic an Antarctic regions is extremely difficult, particularly since areas such as the north slope of Alaska are covered with ice during most of the year.

Conventional steel platforms fixed to the marine bottom provide satisfactory structure for drilling and related oil field operations, but such a structure must necessarily be very large and ponderous to resist the forces of shifting pack ice. This is also true of artificial islands made of earth or other fill material where such material is available. In addition, such structures are permanent and cannot be moved to new drill sites once drilling is completed at the first site. There are also environmental concerns, a large platform or earth island being a permanent disruption of the native environment.

U.S. Pat. No. 3,750,412, issued Aug. 7, 1973, and U.S. Pat. No. 4,094,149, issued June 13, 1978, disclose artificial ice islands constructed on natural ice. Such islands are environmentally less objectional compared to earth islands, but they are incapable of construction in open waters. Consequently, the initial winter season cannot be utilized to build up the ice mass of the island. Instead, the water must first be allowed to freeze to sufficient thickness, or a large ice floe must be towed to the drilling site from somewhere else. In addition to these shortcomings, the islands are incapable of movement to another drill site after they are completed. The cost of constructing such a permanent artificial island at each drill site is prohibitively expensive.

SUMMARY OF THE INVENTION

According to the present invention an off-shore ice island structure is formed in the open sea, and allowed to become frozen into the shelf ice with the onset of the winter season. It is then flooded with successive sheets of water at intervals long enough to allow freezing, and the weight of the accumulated ice sinks the island until it rests solidly upon the ocean bottom. The island is maintained in its frozen state during thaw periods by suitable means such as insulation and refrigeration coils or elements located in high heat loss areas.

The ice island structure is adapted for transfer to a new location or drill site during a thaw period by circulating heated fluid through refrigeration coils in its base to facilitate separation from the ocean bottom, and by melting the upper portion of the ice island with warm water to speed natural melting. The melting ice is scraped off and dumped into the surrounding sea until the island is light enough to float. Air is then introduced beneath the island to assist in separating it from the ocean bottom, and it is then towed to the new drill site. Cooling fluid is then circulated in the refrigeration coils in the island base to preserve and build the ice thickness and prevent further erosion of island base during the move to the new site.

Because the ice island structure can be constructed in open waters, a major part of the construction is completed prior to the onset of cold weather. Consequently, more of the colder season can be utilized for freezing water to build up the mass of the ice island, as compared with the time previously taken waiting for shelf ice of a sufficient thickness to form so that walls, dikes or the like could be erected. In addition, particularly in deeper waters reached by "march-out" of the island during successive annual freezing seasons, the circulation of cooling fluid in the base of the island results in rapid accretion of ice downwardly even prior to the onset of weather cold enough to freeze the island surface.

The present ice island structure comprises a plurality of separate, elongated cylindrical wall elements adapted to be arranged in peripherally continuous, vertically oriented fashion to define a bounded space. The elongated elements are buoyant so that they can be floated or towed to the open water construction site, and each of at least the lowermost or first installed set of elements includes a hollow lower portion into which sea water can be admitted to vertically orient the element.

The wall elements preferably include means whereby they may be joined at their sides in peripherally continuous relation, the joints being adapted to permit a limited degree of relative pivotal movement. This enables the elements to be arranged in a circular configuration, or even in an oblong configuration, if that is indicated to better resist the currents and ice mass movement prevailing in the area.

The initially erected wall elements may constitute joined split halves of tubular cross section, and insulated at their juncture with suitable gasket material.

The elements include means whereby the flooded lower portion may be blown and thereby made buoyant. The upper portions of some or all of the wall elements, can be filled with a closed cell foam or similar buoyant material to exclude sea water and thereby float, in the manner of a spar buoy, and also to provide insulation for reducing heat intrusion from the sea during the warmer of thaw periods.

The ice island structure includes primary pumping means for drawing water from beneath the island to intermittently flood its upper surface. The primary pump means is adapted to be purged of water to prevent freezing during the shut-down periods while the water is freezing on the island. Secondary pump means are provided for pumping water from the water surrounding the island once the island has grounded upon the marine bottom and the primary pumps have become inoperable. These secondary pumps are reversible for removing surface brine accumulations during freezing of the ice island. In this regard, sea water, containing approximately 35% salt, will reject up to 90% of the salt during freezing, with pure ice crystals rejecting the brine, until the utectic point at −22° C. is reached. Means to remove these accumulations is claimed.

The present ice island structure preferably also includes an inner wall or caisson, and suitable bracing and locking members to maintain the walls in position and prevent shifting of the walls relative to the contained ice mass.

As previously indicated, the grounded ice island structure is useful as a drilling platform, in which case the central caisson is utilized to drill and bring in the well, cap it, and construct a work pit below the sea bed for installation of the usual permanent valving or "Christmas tree" structures.

It is important to note that the capability of towing the ice island structure to a new drill site allows it to be "marched out" for use in deeper waters. That is, the island is towed or marched out to deeper waters to await colder weather with the island base refrigeration coils operating to effect subsurface ice growth in advance of the colder weather. The ensuing cold season enables second season ice to be accumulated on the first season ice so that a greater weight of ice is available to sink the island to the greater depths desired. This opens up new areas for oil exploration, and provides a ship mooring facility in deeper waters.

Other objects and features of the present invention will become apparent from consideration of the following detailed description taken in connection with the accompanying drawings.

BRIEF DESCRIPTION OF THE DRAWINGS

FIG. 5 is an enlarged elevational view of the elongated cylindrical elements of which the outer wall is made, including a showing of one of the ice bar locks;

FIG. 6 is a view of the components which make up the elongated cylindrical elements, the components being shown in nested relation for compact shipment and storage;

FIG. 7 is a view taken along the line 7—7 of FIG. 5;

FIG. 8 is a view similar to FIG. 7, but illustrating the end-to-end abutment connection of one cylindrical element to a superposed cylindrical element;

FIG. 9 is an enlarged view taken along the line 9—9 of FIG. 1;

FIG. 10 is an enlarged view taken along the line 10—10 of FIG. 1;

FIG. 11 is a top plan view of a portion of the outer wall and adjacent insulation retainer panels; and FIG. 12 is a view similar to FIG. 5 but illustrating an embodiment of the outer wall in which an internal strenghthening cylinder is disposed within each of the cylindrical wall elements for reinforcement.

DESCRIPTION OF THE PREFERRED EMBODIMENT

Figure 1:
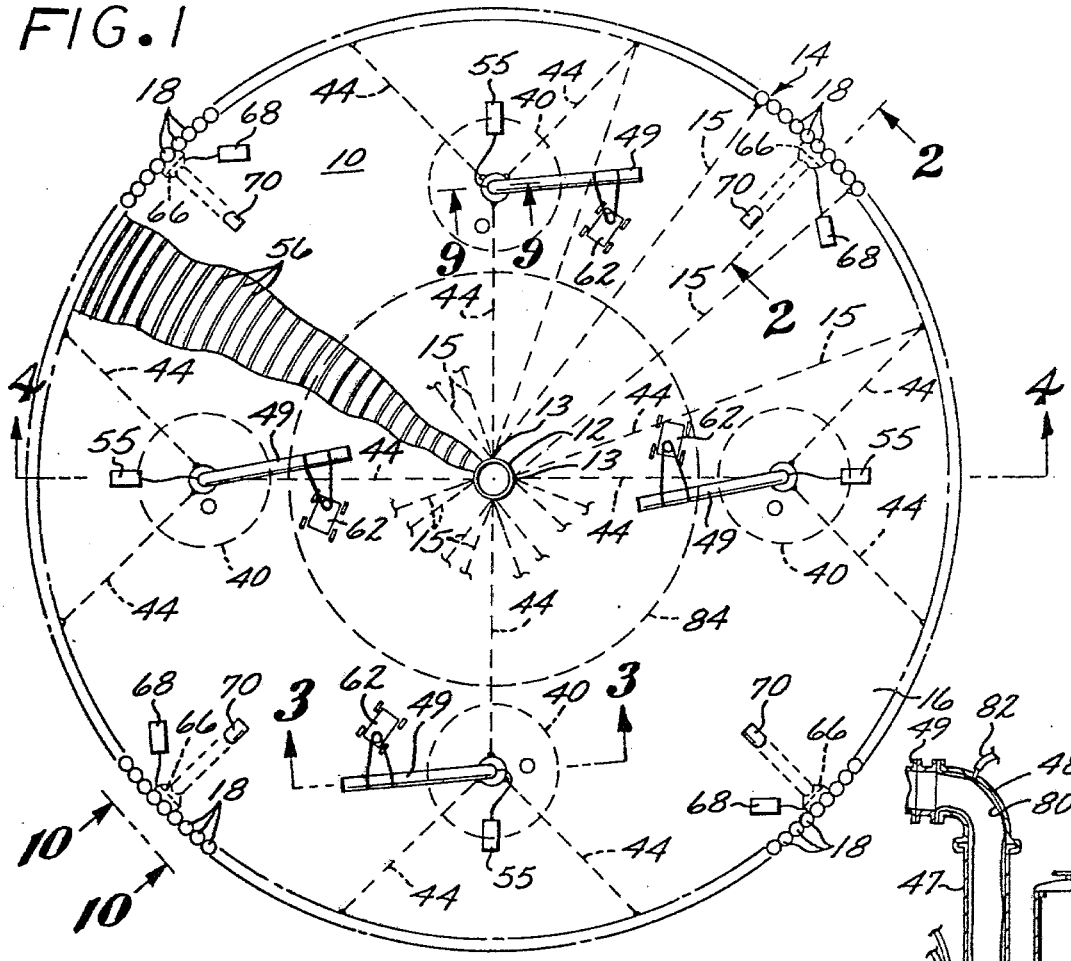
FIG. 1 is a plan view of the present ice island structure, as the same would appear during construction.

Referring now to the drawings, there is illustrated an ice island structure 10 for use in exploiting substrata resources such as oil. The structure 10 comprises, generally, a central caisson or inner wall 12 and a circular or peripherally continuous, vertically oriented wall 14 in concentric relation to the inner wall 12 and defining a bounded space 16.

As will be described subsequently, the bounded space 16 is the area within which water is frozen to form the ice island which serves as the platform for usual oil drilling equipment and drilling rigs, power supplies, refrigeration and heating equipment, pumping equipment, a draw works house for pulling strings of pipe, other necessary working tools and the like. Other applications for the ice island may dictate other support facilities. For example, the island could be used in the North Slope region of Alaska as a ship docking facility, and also to store all kinds of off-loaded materials for later transport to shore. It could also be provided with a central storage tank for holding refrigerated, liquified hydro-carbon products.

The inner wall 12 is made of relatively heavy plate steel, approximately one inch thick, and it is vertically ribbed with a plurality of vertically oriented I-beams (not shown) having pad eyes 13, FIG. 1 to which bracing cables or the like can be attached, as indicated generally at 15 and 44.

The diameter of the wall 12 is approximately 20 to 200 feet or more, depending upon the number of wells to be drilled. The diameter is also preferably large enough to enable a working crew to cap the well or wells and gain access to the marine bottom to construct a work pit for installation of usual permanent valving or "Christmas tree" structure below the natural sea bed surface. If the structure 10 is to be used to store liquified natural gas (LNG) or liquified petroleum gas (LPG) or the like, the wall 12 is made considerably larger for accommodating an insulated storage tank (not shown). The diameter of the wall 12 in such a case would be as much as 20 to 1000 feet or more. The ice surrounding the bottom and sides of such a tank protect it from possible impact and insulate the tank from undesirable heat loss. Although not shown, such a tank could be protected by a heat insulating covering dome, such as a double-walled, reflective and inflatable structure.

Since one of the objects of the present invention is to provide an ice structure which can be constructed in the open sea, or which can be punched through relatively thin shelf ice, the lower portion of the inner wall 12 is preferably fabricated at a convenient work site remote from the planned location of the ice island, and floated to the ice island construction site. For this purpose, suitable floats (not shown) are temporarily attached to render the inner wall buoyant. Alternatively, the opposite ends of the initial section of the inner wall 12 can be temporarily closed or capped to define an inner closed space for buoyancy.

The outer wall 14 comprises a plurality of separate, elongated cylindrical elements 18 approximately one-half inch in wall thickness, 36 to 48 inches in diameter and 8 feet long. As best seen in FIGS. 5–10, the lower tier or initially installed elements 18 each includes an upper portion 19 made hollow for buoyancy, or made buoyant by filling it with foam-in-place, closed cell plastic form material 20. Each lower tier element 18 also includes a lower portion having a void space or air chamber 22 open at the bottom, and closed at the top by a transverse partition 24. This two-part construction is typical of the elements 18 which are first assembled to define the lower tier of the outer wall 14. The later assembled or upper tier elements 18 do not have the two compartment arrangement, being void or hollow, or completely filled with foam material 20 for heat insulation. Such upper tier elements 18 preferably each includes a coextensive internal strengthening means, such as the cylinder 26, as best seen in FIG. 12. These are placed in the upper tier elements 18 as the wall 14 is upwardly extended during construction of the island, and improve resistance of the wall 14 to forces imposed by surrounding shelf or pack ice and the like.

The lower tier elements 18 each include air vent and check valve blow means in the form of an elongated vent tube 28 extending from the upper end of the element 18 downwardly through the chamber within which the foam material 20 is located, and terminating in fluid communication with the air chamber 22.

The volumes of the spaces allotted to foam material 20 and to chamber 22 are proportioned to cause the element 18 to become vertically oriented, with approximately three feet of freeboard, when air is vented through the tube 28 to flood the chamber 22 with sea water. After the lower tier elements 18 are vertically oriented and assembled to form the wall 14, as will be seen, their tubes 28 are coupled to suitable compressor and check valve equipment (not shown) to apply air under pressure to the chambers 22 to blow or drive sea water out of the chambers. The resulting additional buoyancy increases the freeboard of the elements 18 and provides a larger contained volume for ice formation in the bounded space 16.

Each of the elements 18 is preferably made in two nestable parts 30 and 36 to facilitate transportation to the island site, and to minimize the storage and shipping space required. Each part 30 and 36 is generally semicylindrical for nesting, as seen in FIG. 6, and includes elongated, diametrically opposite side edge flanges. The opposite side edge flanges of the outer part 30 comprises a coextensive, generally cylindrical bead 32 and a coextensive C-shape channel or socket 34, respectively. The socket 34 closely receives the bead 32 of an adjacent part 30 for assembly of the elements 18.

The side edge flanges of the inner part fit against the side edge flanges of the outer part 30 and are secured in position by suitable fastener assemblies 38, as seen in FIG. 5. For airtight integrity and for heat insulation, the lower tier elements 18 include a suitable gasket 41 or other sealing means between the clamped together side edge flanges of the parts 30 and 36. The gasket 41 forms an insulating barrier which reduces heat loss from the interiorly located part 36 to the exteriorly located part 30.

Summarizing the foregoing, the parts 30 and 36 are transported during the summer thaw season to the construction site for the island, and they are there assembled on a work barge or the like to form the individual elements 18. The latter are then punched downwardly through any thin ice which might be present at the site or, more commonly, floated in the open sea at the site. Air is vented through tubes 28 to flood the chambers 22 with sea water and thereby orient the elements 18 in upright positions.

A crane or the like on the construction barge is used to hoist one of the floating elements 18 to a point where its socket 34 is vertically aligned with the bead 32 of an adjacent floating element 18. The hoisted element 18 is then lowered until the socket and bead portions of the pair of elements 18 are coextensive. A threaded U-bolt 39, FIG. 5 is disposed through upper complemental holes in the side edge flanges of the portions 30 and 36, and fastened in position by suitable nuts, the holes being those provided along the lengths of these flanges for the fastener assemblies 38 and the ice locks 58. This locks the elements together, and yet enables a limited amount of pivotal movement of the socket 34 of one element 18 about the axis of the complemental bead 32 of the adjacent element 18. In similar fashion, all of the lower tier elements 18 are connected together to form a peripherally continuous, vertically oriented lower tier of the outer wall 14.

The elements 18 forming the lower tier of the outer wall are maintained in position by suitable lines (not shown) extending to anchors on the sea bottom. Alternatively, they may be secured to usual temporary piles (not shown) previously driven into the sea bed. The assembled elements 18 are thus fixed in location for attachment to other portions of the ice island stucture, and for freezing in of the assembly at the exact site desired upon the onset of the cold season.

The other components of the ice island structure to be attached to the elements 18 are arranged in position within the space bounded by the wall 14. These components include a plurality of igloo or dome-shaped pump housings 40 which have a generally circular cross-section, are closed at the top, and are open to the sea at the bottom. Each is supported at its base upon a circular float 42 to buoy it upon the water surface. Four of the housings 40 are arranged in circumferentially spaced apart relation, as best seen in FIG. 1, and suitable cables 44 are connected between the housing 40 and the outer wall 14, and between the housings 40 and the inner wall 12, to fix the housings in position. A layer of anti-freeze can be placed on the water within the housings to discourage later ice formation.

Each housing 40 serves an an enclosure for a hydraulically operated submersible pump 46 which is suitably braced and secured in the position shown. The intake portion of the pump projects below the plane of the float 42 for pumping water from beneath the ice island structure, while the discharge portion of the pump is connected to the vertical run 47 of a discharge conduit having an elbow or swivel 48 pivotally connected to its upper end, as seen in FIG. 9. The other end of the swivel 48 is connected to a horizontal run 49 of the discharge conduit.

Figure 3:
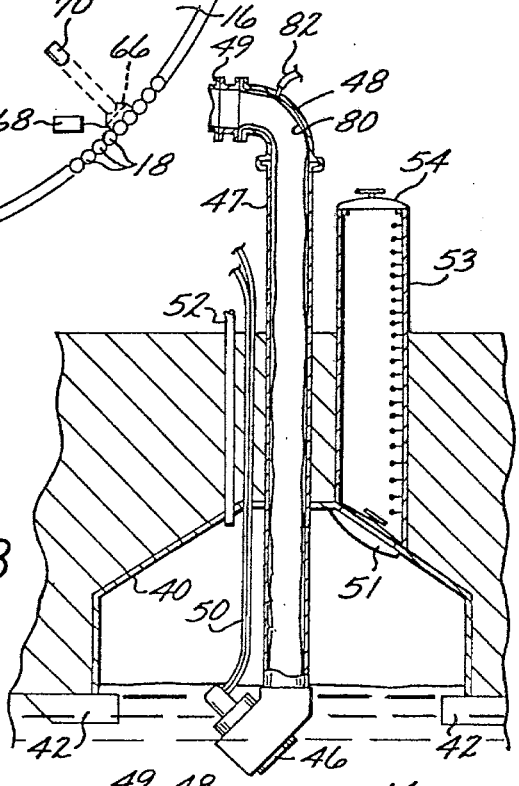
FIG. 3 is an enlarged view taken along the line 3—3 of FIG. 1.

The vertical run 47 is preferably insulated and extends upwardly through the upper wall of the housing 40 in fluid sided relation. Hydraulic lines 50, as best seen in FIG. 3, extend through suitable openings in the housing 40 and connect the pump to suitable support equipment 55 located top side. As will be seen, the equipment 55 is preferably not located in place until natural ice has formed to a thickness sufficient to support it.

Each housing compartment 40 is pressurizable to a greater and greater level through a pipe 52 to exclude sea water as the ice island structure descends towards the ocean bottom.

A manhold trunk 53 extends from the surface to the housing 40 and is accessible to the housing 40 by means of a hatch or manhole 51. Another hatch or manhole 54 at the top of the trunk 53 allows the trunk 53 to be pressurized to the same level as the pressure in the housing 40.

Refrigeration tubes or lines 56 to maintain the base of the ice island structure in its frozen state through the summer or thaw season are also properly located and assembled at this time. The ends of the hollow lines 56 are plugged so they will float in the bounded space 16. Although not shown in detail, the lines 56 are arranged in concentric circles or grids within the bounded space 16, as diagrammatically shown by the partial showing of arcuate lines 56 in FIG. 1. The lines 56 are arranged in sets of manifolds and extend to all areas where refrigeration is important to maintain the integrity of the island during the thaw season, such as across the bounded space 16 and adjacent the inner and outer walls 12 and 14. The lines 56 at the island base also facilitate freezing of the sea bed adjacent the base upon island grounding, which promotes adherence of the island to the sea bed. Also, when the island is to be moved to a new site, the base lines 56 promote melting of the island base by circulation of a heated fluid through them. The lines 56 are attached where convenient to the outside of the housings 40 and to the inner and outer walls 12 and 14. Although not shown, the lines 56 may also be attached to upwardly extending bracing elements. When such elements are frozen in place they will support the lines 57 at such times as the island base is melted preparatory to moving the island.

During the thaw and pre-freeze period, a plurality of elongated rods or ice locks 58 are attached to the walls 12 and 14 and extend into the bounded space 16, as seen in FIG. 5. They are fastened within certain ones of the openings which are adapted to receive the fastener assemblies 38, and prevent relative vertical movement between the walls 12 and 14 and the ice which later forms within the space 16. In addition, the plurality of bracing cables 15 and 44 are radially extended from the pad eyes of the wall 12 and are fastened by certain ones of the fastener assemblies 38 to the side edge flanges of the outer wall elements 18. The braces 15 extend like the spokes of a bicycle wheel and may be tensioned to prestress the ice island structure and thereby preserve a particular configuration of the outer wall 14 under the stress of the expanding ice in the bounded space 16, and under the stress of ice pressing inwardly from outside the island.

As best seen in FIG. 11, elongated arcuate wall portions 37 are preferably secured in any suitable manner to the inner faces of the assembled outer wall elements 18, and the space thereby defined is filled with suitable plastic foam material. This provides insulation against heat loss, and also acts as a crushable expansion space which can accommodate expansion of the forming ice in the space 16, thereby avoiding unduly high stresses upon the outer wall 14.

The outer surfaces of the outer wall elements 18 are preferably coated with a suitable slippery gel material, petroleum product or the like to reduce friction with ice forming during the cold season, thereby facilitating the desired descent of the ice island structure to the ocean bottom, as will be seen.

The diameter of the outer wall 14 is dictated by the mass of ice necessary to weight the island enough to achieve a good bond with the ocean bottom and prevent lateral movement. In a typical situation the diameter would be a thousand feet or more. The final height of the island depends upon the depth of water at the desired site and the freeboard desired. In 20 feet of water a freeboard of approximately 5.2 feet is required to overcome inherent ice buoyancy. Practical grounding integrity for a secure water-free inner work space would require an additional freeboard of from 5 to 20 feet of ice.

The open sea assembly or fabrication just described greatly simplifies the logistics of constructing the ice island structure, and enables maximum utilization of the full ten month cold season typical in Arctic regions, for example. Although the phrase "open sea" is used, it is contemplated that assembly could be delayed until thin shelf ice has formed, in which case the buoyant elements 18 are upended with a crane or the like and punched through the shelf ice for longitudinal slidable interlocked assembly to adjacent elements 18 already punched into place. Waiting for a thin shelf ice to form would delay initial construction of the ice island, but this is advantageous in that the island can be fixed in position without any need for pilings or anchors. In contrast, if the construction of the island depended upon use of shelf ice frozen to a thickness sufficient to support all of the elements 18 on the ice, a shorter period of cold weather would be available to build up the thickness of the island. On the other hand, construction in the open water prior to shelf ice formation also has its advantages. There is only approximately twenty days of weather "window" or warm weather and open water facilitates movement of construction. When ice forms, such tugs and barges require ice breaker assistance to move about and leave the area.

Upon onset of the cold season, the sea within the space 16 freezes the housing 40, refrigeration lines 56, ice locks 58, and bracing cables into position. After the natural ice has thickened to approximately one or two feet, the support equipment 55 for the pumps 46 is placed upon the ice. Such support equipment 55 includes usual and conventional gasoline or diesel powered systems adapted to provide hydraulic fluid under pressure sufficient to drive the pumps 46. Other equipment placed upon the ice at this time includes bulldozers and similar ice sweeper-scrapers for removing brine ejection (not shown), and wheeled vehicles 62 which carry suitable bracing to support the horizontal run 64 of each discharge conduit 48. Each vehicle 62 can pull its associated run 64 through a 180 degree path in opposite directions so that water coming out of each run 64 is evenly distributed with a circular area, the run 49 and its attached swivel 48 pivoting about a bearing or swivel connection between the swivel 48 and its associated vertical run 47.

The support equipment 55 is operated in intermittent fashion, running the pumps 46 to take in sea water from beneath the ice island structure for propulsion out of the runs 49 and onto the ice island. The pumps 46 are then stopped long enough to allow the water to freeze.

The sea water discharged from the runs 64 covers the refrigeration coils 56, locks 58 and cable braces. Once the water has frozen to a sufficient thickness above these components, the sweeper-scrapers (not shown) are operated to scrape off the upper layer of brine slush ice which characteristically forms on freezing of ice. Brine and impurities migrate during freezing and scraping them away reduces intercrystalline inclusions and refines and strengthens the ice crystal structure. Constant removal of such impurities is important to enhance the structural integrity of the ice island.

Preferably the scraping of the ice buildup is controlled so that the ice surface slopes downwardly toward the outer wall 14 to carry brine in that direction. This can be facilitated by temporary use of flexible rubber hose or the like (not shown) to form channels. The brine thus is channeled to flow toward the outer wall, leaching out sub-surface brine inclusions as each ice layer is frozen. Any blowing snow, which is almost pure water, is gathered and used in the construction of the ice island.

A plurality of reversible secondary pumps 66 which are operated by power units 68, are located at the outer wall 14. These pumps are installed in certain ones of the lower tier elements 18 and are activated after formation of the lowermost or natural ice layer of the island to eject accumulated brine. The brine is scraped toward the pump intake conduits 70.

Figure 2:
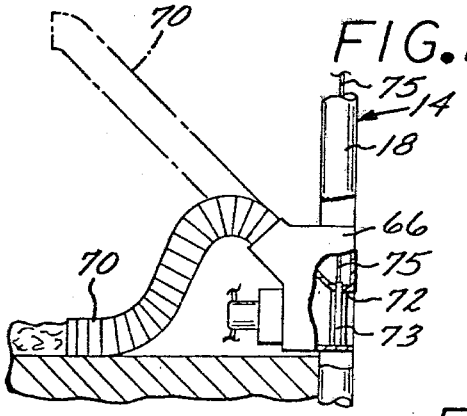
FIG. 2 is an enlarged view taken along the line 2—2 of FIG. 1.

The brine is drawn into the conduits 70, connected to the pumps 66, as best seen in FIG 2, for discharge through suitable valves 73 mounted in openings 72 provided in certain ones of the elements 18. As shown in phantom outline in FIG. 2, the conduits 70 are raised, and extension sections are added for suction at higher levels as the ice island increases in height. Like the primary or flooding pumps 46, the brine ejection or secondary pumps 66 are operated intermittently being shut-down at intervals to allow freezing of the successive layers of water. Care is exercised to completely pump out the brine from the conduits 70 and pumps 66 during shut-down periods to minimize freezing of the brine and the like in the system. Heating coils or tapes, hydraulic oil flushing, air blow out means or the like (not shown) may be employed for this purpose.

The foregoing process of flooding the island surface with water, allowing it to freeze, scraping away brine concentrations, and pumping off the accumulated brine, is continued through the cold season to build up the height of the ice island. During this repetitive flooding and freezing the inner and outer walls are also extended in height to contain the accumulated ice. Cylindrical extensions of the inner wall 12 are superposed upon the initially placed portions and welded or otherwise fixed in place to exclude water and ice from the space within the wall 12.

In similar fashion upper tier elements 18 either hollow or completely filled with foam, as previously indicated, are erected on top of the initially placed lower tier elements 18 and interlocked to upwardly extend the outer wall 14. If it is anticipated that high stresses will be imposed upon the wall by the surrounding shelf or pack ice, the reinforcing cylinders 26 are inserted into each of the upper tier elements 18 in the direction of approach of the ice pack as shown in FIG. 12. Although circular, a triangular or hexagonal configuration is also suitable.

The end abutted, superposed elements 18 of the stacked tiers of elements 18 are each arranged with their adjacent ends in engagement with the opposite faces of an annular ring 74 which is integral with a cylindrical sealing sleeve 76 surrounding the extremities of the adjacent elements 18, as seen in FIG. 8. It is noted that the side edge flanges and bead and socket portions 32 and 34 terminate short of the ends of the elements 18, thereby being spaced apart at the joint, to accommodate the sleeve 76. The abutting elements 18 are secured against separation by a strap 78 attached by adjacent ones of the fastener assemblies 38. If desired, the attachment could be made by a collar (not shown) having oppositely threaded extremities threaded to the upper and lower elements 18.

As was the case with the lower tier elements 18, the upper tier elements 18 are slidably joined interlocking at their side edges during the upward extension of the wall 14. In addition, the arcuate wall portions 37 are attached to the upper tier elements 18 as the wall 14 is extended upwardly.

Figure 4:
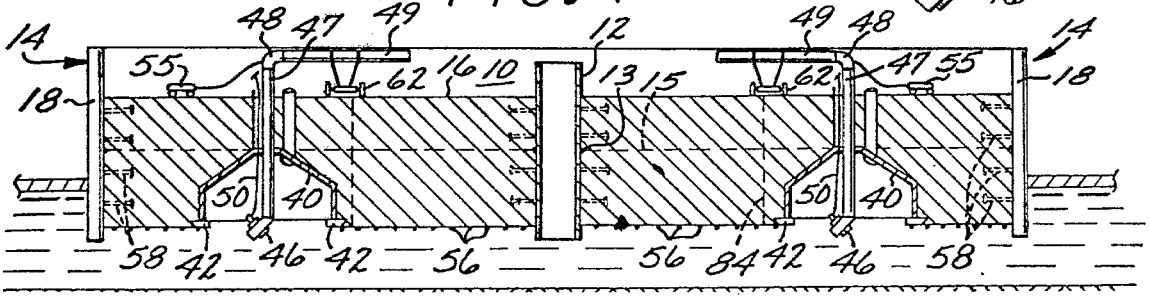
FIG. 4 is an enlarged view taken along the line 4—4 of FIG. 1.

As the height of the ice island increases, additional sets of ice locks 58, refrigeration lines 56 and bracing cables 15 are added as needed, as seen in FIG. 4, and the pressure in the housings 40 is suitably adjusted to counteract outside hydrostatic pressure and exclude sea water as the island sinks. This also provides optimum location of the pump inlet at each housing approximately one to two feet below the ice crust.

When the ice island initially sinks, the discharge openings 73 and valves 72 of the secondary pumps 66 will become aligned with the natural ice layer and must be shut down until the discharge openings 73 and the valves 72 are located below the natural ice layer. The valves 72 can be any mechanically or hydraulically operated type and the actuating line or linkage to shut the valves at this time are generally indicated at 75 in FIG. 2. During the shutdown period, removal of brine is accomplished by bulldozing or scraping the brine onto the surrounding natural shelf ice through openings in the outer wall 14. Such openings can be temporarily formed by incompletely sliding an element 18 downwardly into position, leaving a temporary gap of two or three feet. As soon as the openings 73 and valves 72 are located below the surrounding shelf ice, by virtue of the continued descent of the increasingly heavier ice island, the linkages 75 are operated to open the valves 72, and the pumps 66 are intermittently operated as before. The brine discharge is now below the surrounding shelf ice.

Upon grounding of the ice island upon the marine bottom, the lower edges of the walls 12 and 14 engage and bite into the ocean substrata. The primary pumps 46 tend to dredge small depressions into which most of the water beneath the island flows for removal. The pumps 46 are then shut off and the secondary pumps 66 are operated in a reverse direction to pump water from outside the island to the surface of the island. After the island is completed and grounded the pumps 66 can be used to circulate sea water, which is at a temperature of 29° to 30° C., through condensers for chilling the refrigerant which is circulated through the ice island refrigeration coils to maintain ice island integrity.

This pumping of sea water from outside this island is continued until the desired island height is achieved. Brine during this period is removed by dumping it onto the surrounding shelf ice through temporary openings formed in the outer freeboard wall by incompletely sliding an element 18 downwardly into position, as previously mentioned.

Any small amount of water remaining between the ice island and the marine bottom tends to become frozen by the superjacent mass of the ice island upon actuation of the first installed or lowermost refrigeration lines 56. This insures a strong earth-to-ice seal through freezing together of the island base and the ocean bottom. Conversely, when detachment and reflotation of the island is desired, heated fluid is injected into the lines 56 to melt the layer beneath the island and the sea bed. Thereafter, injection of air and the natural buoyancy of the island ice will refloat the island.

Each conduit set of swivel 48 and vertical run 47 is especially designed to slow freezing of water therein and enable removal of water during the periods when the surface water is being allowed to freeze and the pumps 46 are not operated. More specifically, the rigid outer walls thereof are covered by a suitable insulating material (not shown) to slow freezing. In addition a flexible inner sleeve 80 made of rubber or the like extends internally of the length of the swivel 48 and run 47 and is joined to the ends of the rigid outer walls thereof. An air line 82 extends into the annular space between the outer walls and the flexible sleeve 80, as best seen in FIG. 9.

When water is pumped through the run 47 and swivel 48, the sleeve 80 is pressed outwardly against the outer walls by development of a vacuum through the line 82. When the pumps are not operated, suitable air pressure means (not shown) are employed to pressurize the annular space, thereby collapsing the sleeve 80 and driving out any remaining water. Only a relatively small ice plug can then form at either end, and these can easily be blown out prior to resumption of pumping by depressurizing the inner sleeve 80, or by circulating warm water through the conduit to the area of the ice plugs. Pumping can then be resumed to blow out the remaining ice plugs and flood water throughout the area swept by the horizontal runs 49.

The weight of the rounded island normally prevents water intrusion beneath the island. However, where coarse grained gravel structures or the like are encountered, water intrusion can be prevented by conventional means such as hydraulic injection of grout through peripheral openings drilled in the ice. Grout discharged through these openings passes into any porous structures below the island and prevents water intrusion. This is done in conjunction with removal of ice and water from within the inner wall 12, so that this inner area is sealed sufficiently to gain access to the sea bottom. The operation is continued until it is certain that water is not entering the inner wall area.

Upon grounding of the ice island, a base of horizontal I-beams (not shown) is set upon the island surface adjacent the inner wall 12, and are welded to the inner wall. Next, vertical I-beams (not shown) are attached at their lower ends to the horizontal I beams, extending upwardly to the height desired for the drilling platform above the ice island surface. Ice buildup is continued to the planned height of the island, with sets of lines 56, locks 58 and cables 15 placed at the various levels as needed.

Insulation blankets, timber, covering gravel, or the like are preferably laid upon the finished island surface to insulate it during the summer thaw season, and to provide a proper surface for storage areas and roadways in and around the central work area. Refrigeration lines are preferably also laid down for use in compensating for such heat loss as does occur.

A drill rig work deck can then be laid out over the inner wall 12 and attached to the vertical I beams surrounding the inner wall 12. Usual drilling equipment is then mounted upon the work deck.

The ocean bottom within the inner wall 12 is evacuated to form the work pit within which usual permanent valving or "Christmas tree" structures are installed below the natural sea bed surface. Once usual drilling is completed and the well or wells are brought in and capped, the wells are connected to the valving equipment so that the oil can be drawn off in pipes going to shore, for example.

The work pit can be provided with a suitable cover if the island is to be transferred to another drill site during the thaw season. However, if drilling operations are to continue through the following cold season, the refrigeration equipment is operated to keep the temperature of the ice below freezing.

If the ice island is to be moved to a new drill site, this is done during the summer thaw. Some of the mass of ice must be removed to render the island sufficiently light that it can be separated from the marine bottom. Natural thawing of the upper ice layers is allowed to occur and is preferably hastened by pumping heated sea water onto the ice to soften it and permit its removal by scrapers or the like. The ice removal is done evenly to preserve the stability of the ice island, and care is taken to avoid damage by the scrapers to any refrigeration lines, ice locks or bracing cables. Excess equipment and supplies are also removed.

As the weight of the ice island decreases enough that its natural buoyancy is enough to float it, the tendency of the island to separate from the ocean bottom is restrained primarily by the ice-to-earth bond. To effect separation, heated gas or liquid is passed through the lower coils 56 to thaw the adjacent base area. Air is then injected into the housings 40, and this air passes between the undersurface of the island and the ocean bottom and effects final breaking of the bond. The refrigeration equipment is again put into operation, and insulating blankets are placed over the island surface to slow further melting and thawing of the ice mass surface while it is being towed to its new location.

When the island reaches its new location, it is maintained in position until the onset of the next cold season by suitable anchors or by attachment to suitable pilings (not shown) driven into the ocean bottom.

When the natural shelf ice is frozen to a thickness sufficient to maintain the ice island firmly in position, the repetitive process of flooding and freezing proceeds until the structure becomes heavy enough to sink to the bottom as before.

By utilizing the present method and apparatus for forming an ice island, it is possible to construct such an ice island in the open sea, and to utilize the maximum portion of the cold season for ice formation. Consequently, the mass of the island can be built more quickly so that drilling in deeper waters can be achieved, as compared with construction of the ice island on natural ice. Further, the unique assembly procedure enables rapid, on the site construction of an outer wall having high structural integrity, which is critical during mild summer weather.

Ice islands in land locked lakes or the like are usually subject to minor lateral stresses, winds or tides and therefore can be made considerably smaller in mass, compared to offshore shelf islands. Further, offshore islands on firm subsoils in relatively shallow, or sheltered waters need not be as large or require as much freeboard as islands designed for deeper waters in more exposed areas. Refrigeration of the base of the island may even by unnecessary to maintain solid engagement with the ocean bottom, or resist lateral dislocation.

The outermost and deepest continental shelf areas usually require an ice island structure having a height greater than what can be attained in one cold season, and consequently such areas require the refloatable type of ice island described above. Such an ice island would be several thousands of feet in diameter to resist the lateral thrust forces existing in those areas. Consequently, the ice island initially fabricated in the shallower waters must be made large enough in diameter for the deeper ocean sites for which it is eventually destined.

If an inner tank is to be provided so that the ice island can be used to store liquified gas or the like, the tank would be located as generally indicated at 84 in FIGS. 1 and 4. The dimensions and materials will vary according to the size of the island, and the volume and nature of the material to be stored. The tank would be fluid tight and therefore enclosed on all sides. If the stored material is liquid natural gas (LNG), it will be necessary to operate the refrigeration system to keep the temperature low enough so that the liquid does not pass into a gaseous phase. However, in Arctic regions, for example, the natural temperatures are low enough so that no refrigeration may be necessary during the cold season for a liquid gas such as propane or butane (LPG). In some instances, if the liquid gas is to be burned or otherwise used at the site for power or for heating of living quarters and the like, the heat required for conversion of the gas to its gaseous phase can be provided by circulating it through portions of the island by means of the supplementary refrigeration lines. During the thaw season such a procedure would help to prevent undesirable thawing of the ice island.

Various modifications and changes may be made with regard to the foregoing detailed description without departure from the spirit of the invention.

I claim:

1. Apparatus for forming an ice island structure comprising:

a peripherally continuous, vertically oriented outer wall means defining a bounded space, at least the lowermost tier of said outer wall means including a plurality of separate, elongated buoyant elements, each having a hollow lower portion and air vent and blow means openings into said lower portion for allowing sea water to flood said lower portion to aid in vertically orienting each said element in the water, and for pressurizing said lower portion to blow said lower portion; and means for introducing water into said bounded space for freezing by the elements whereby the mass of frozen water accumulates to form an ice island adapted to descend of its weight toward the substrate surface.

2. Apparatus according to claim 1 wherein each said element includes elongated side edge portions vertically slidably engageable with the corresponding side edge portions of adjacent ones of said elements.

3. Apparatus according to claim 1 wherein each said element comprises complemental, nestable havles adapted for connection at their side edges to form each said element.

4. Apparatus according to claim 2 wherein said outer wall means comprises a plurality of superposed tiers of said elements, and said side edge portions terminate short of the ends of the elements, and including connecting sleeves extending between the adjacent extremities of said elements in each tier of said outer wall means and the extremities of said elements in the next superposed tier of said elements.

5. Apparatus according to claim 4 and including connecting means extending between the side edge portions of superposed said elements and constraining said elements against vertical separation from each other.

6. Apparatus according to claim 1 wherein said outer wall means comprises a plurality of superposed tiers of said elements, and including a cylindrical inner wall means disposed in coaxial relation within said elements of at least certain of the upper tiers of said elements.

7. Apparatus according to claim 1 wherein said outer wall means comprises a plurality of superposed tiers of said elements, and including arcuate wall portions fixed to the inner surfaces of said elements of at least certain of said tiers of elements, and compressible insulating material disposed in the spaces between said elements and said arcuate wall portions.

8. Apparatus according to claim 1 and including vertically oriented, cylindrical inner wall means coaxial with said outer wall means and closed for containment of liquified gas and the like whereby the ice of said ice island structure tends to protect and insulate the stored material.

9. Apparatus according to claim 3 and including heat insulating means disposed between said halves.

10. Apparatus for forming an ice island structure comprising:

a peripherally continuous, vertically oriented outer wall means defining a bounded space, said wall means comprising a plurality of separate, elongated buoyant elements, adjoined at their side edges and arranged in tiers in superposed relation;

a plurality of housings in said bounded space and including, respectively, a plurality of pump means open downwardly to the sea;

a plurality of pump means in said plurality of housings, respectively; and a plurality of conduit means extending from said plurality of pump means, respectively, to the surface of the ice island structure for distributing water throughout said bounded space for freezing by the elements whereby the mass of frozen water accumulates to form an ice island adapted to descend of its weight toward the substrata surface.

11. An apparatus according to claim 10 wherein each said conduit means includes a horizontal run adapted to be pivoted throughout at least a portion of a circular path, and means for pivoting each said conduit means through said portion of said path.

12. An apparatus according to claim 10 wherein each of said housings including float means whereby said housings are adapted to float in the open sea during assembly of the ice island structure.

13. An apparatus according to claim 10 and including means for pressurizing said housings to substantially exclude sea water.

14. An apparatus according to claim 10 and including a plurality of secondary pumps adjacent said outer wall means and operative in one state to pump brine slush and the like from the surface of the ice island structure and externally of said structure, said secondary pump means being reversible to a second state for pumping water to said bounded space upon grounding of said ice island upon said substrata surface.

15. An apparatus according to claim 10 and including water discharge means operative upon inactivation of said pump means to drive water out of said conduit means.

16. A method for forming an ice island in a region having freezing temperatures during the cold season, said method comprising the steps of:

floating and connecting together a plurality of elongated buoyant elements in the sea in side-by-side relation in a substantially vertical orientation to form the lower tier of a peripherally continuous outer wall means defining a bounded space;

allowing said outer wall means to become frozen into the ice forming in the sea during the cold season; and operating pumps to discharge water onto the ice in said bounded space through distribution conduits connected to the pumps and extending over portions of said bounded space and allowing said water to freeze within the bounded space, and contemporaneously adding upper tiers of said elements to said lower tier to contain successive layers of discharged water in said bounded space, until the weight of the frozen layers is sufficient to maintain the ice island in grounded relation to the substrata surface.

17. A method according to claim 16 wherein said lower tier elements are successively arranged in vertical orientation on thin shelf ice and are thereafter punched through the shelf ice to float in the open sea, and into assembled relation with other said elements to form said outer wall means.

18. A method according to claim 16 and including the step of employing means to scrape brine concentrations from the surface of the ice in said bounded space and toward said outer wall means, and employing reversible secondary pumps to pump said concentrations to points externally of the ice island.

19. A method according to claim 18 and including the step of reversing said secondary pumps, upon achievement of said grounded relation, to pump water from the periphery of the island below the shelf ice to said bounded space.

20. A method according to claim 16 and including the step of arranging refrigeration lines in said bounded space for location in the base of the ice island.

21. A method according to claim 20 and including the step of circulating cooling fluid through said refrigeration lines to accelerate ice growth downwardly and freeze said substrata surface upon grounding of the ice island.

22. A method according to claim 20 and including the step of circulating heated fluid through said refrigeration lines after grounding of the ice island to facilitate separation of the ice island from said substrata surface preparatory to moving the ice island to a new location.

23. A method according to claim 22 and including the step of halting said circulation of heated fluid and initiating circulation of cooling fluid through said refrigeration coils during movement of the ice island to said new location.

* * * * *

UNITED STATES PATENT AND TRADEMARK OFFICE

CERTIFICATE OF CORRECTION

PATENT NO. : 4,325,656

DATED : April 20, 1982

INVENTOR(S) : Gilbert H. Bishop

It is certified that error appears in the above—identified patent and that said Letters Patent is hereby corrected as shown below:

Column 3, line 8, delete "35" and insert --3.5--;

Column 7, lines 23-25, delete "The lines 56 are attached where convenient to the outside of the housings 40 and to the inner and outer walls 12 and 14.";

Column 7, line 26, delete "also";

Column 7, line 28, delete "57" and insert --56--;

Column 8, line 28, delete "twenty" and insert --eighty--;

Column 9, line 40, delete "Cylindrical extensions" and insert --Extensions--;

Column 9, line 41, before "inner" insert --cylindrical--;

Column 11, line 29, delete "rounded" and insert --grounded--; and

Column 11, line 58, delete "loss" and insert --gain--.

Signed and Sealed this

*Fourteenth* Day of *September 1982*

[SEAL]

*Attest:*

GERALD J. MOSSINGHOFF

*Attesting Officer*

*Commissioner of Patents and Trademarks*